US005918513A

United States Patent [19]

Ho

[11] Patent Number: 5,918,513

[45] Date of Patent: Jul. 6, 1999

[54] SCREWDRIVER HANDLE

[76] Inventor: Howard Ho, P.O. Box 63-247, No. 36-3, He Nan Dong 3 Street, Taichung, Taiwan

[21] Appl. No.: 09/164,994

[22] Filed: Oct. 1, 1998

[51] Int. Cl.[6] ..... B25G 1/08

[52] U.S. Cl. ..... 81/490; 81/450; 81/177.4

[58] Field of Search ..... 81/490, 177.4

[56] References Cited

U.S. PATENT DOCUMENTS 5,802,936 9/1998 Liu ..... 81/450

*Primary Examiner*—Timothy V. Eley
*Assistant Examiner*—Sinclair Skinner
*Attorney, Agent, or Firm*—Charles E. Baxley

[57] ABSTRACT

A screwdriver handle includes a main body having an end releasably engaged with a screwdriver tip. The main body includes two opposite lateral sides each having a compartment defined therein. Two pivotal covers are pivotally connected to the main body to cover the compartments, respectively. Each pivotal cover includes a holder plate formed on an inner side thereof and having a number of holes for holding screwdriver tips and a number of semicircle recesses for holding sockets. When a push pin is pushed, two hooks of the pivotal covers are disengaged with two latches of an engaging member that is moved by the push pin such that the pivotal covers pivot outwardly under the action of two elastic members.

2 Claims, 6 Drawing Sheets

SCREWDRIVER HANDLE

BACKGROUND OF THE INVENTION

1. Field of the Invention

The present invention relates to a screwdriver holder that may receive screwdriver tips and sockets therein for convenient use.

2. Description of the Related Art

Screwdrivers and socket wrenches are often used in daily life. Yet, the user is troubled with carriage and/or storage of the tools. More specifically, it is a usual event that the user cannot find the proper tool when required, or the user has to use a bag or box for carrying all sizes of the tools. The present invention is intended to provide an improved screwdriver handle to solve this problem.

SUMMARY OF THE INVENTION

It is a primary object of the present invention to provide an improved screwdriver handle that may receive a certain kinds of screwdriver tips and sockets to solve the carriage and storage problem.

A screwdriver handle in accordance with the present invention comprises a main body having a first end and a second end releasably engaged with an end of a screwdriver tip. The main body includes a first pair of opposite lateral sides and a second pair of opposite lateral sides. Each of the first pair of opposite lateral walls includes a compartment defined therein. The main body includes a wall defined in an interior thereof and separating the compartments.

Two pivotal covers are provided and each has an end pivotally connected to the main body to cover an associated compartment. Each pivotal cover includes a holder plate formed on an inner side thereof and having a number of holes each of which is adapted to hold a screwdriver tip and a number of semi-circle recesses each of which is adapted to hold a socket. Each holder plate includes a hook formed thereon.

Two elastic members are provided and each has a first end attached to the wall of the main body and a second end attached to an associated pivotal cover. The elastic members are compressed when the pivotal covers are in a closed status.

A first transverse receptacle and a second transverse receptacle are defined in the second pair of opposite lateral sides, respectively. The first transverse receptacle includes an engaging member slidably received therein. The engaging member includes a latch provided on each of two lateral sides thereof for releasably engaged with the hook of an associated pivotal cover. The second transverse receptacle includes a push pin slidably received therein. The push pin is securely connected to the engaging member to move therewith. A spring is provided for returning the push pin and the engaging member.

When the push pin is pushed, the latches of the engaging member are moved to a position not engaged with the hooks of the pivotal covers such that the pivotal covers pivot outwardly under the action of the elastic members.

The first end of the main body may include a track defined therein, and may further comprise a housing having a base plate with a sliding member slidably received in the track. The housing includes a notch defined in a periphery thereof In addition, a coil ruler may be received in the housing and include a stop formed on an outer end thereof, the stop having a size greater than that of the notch of the housing.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
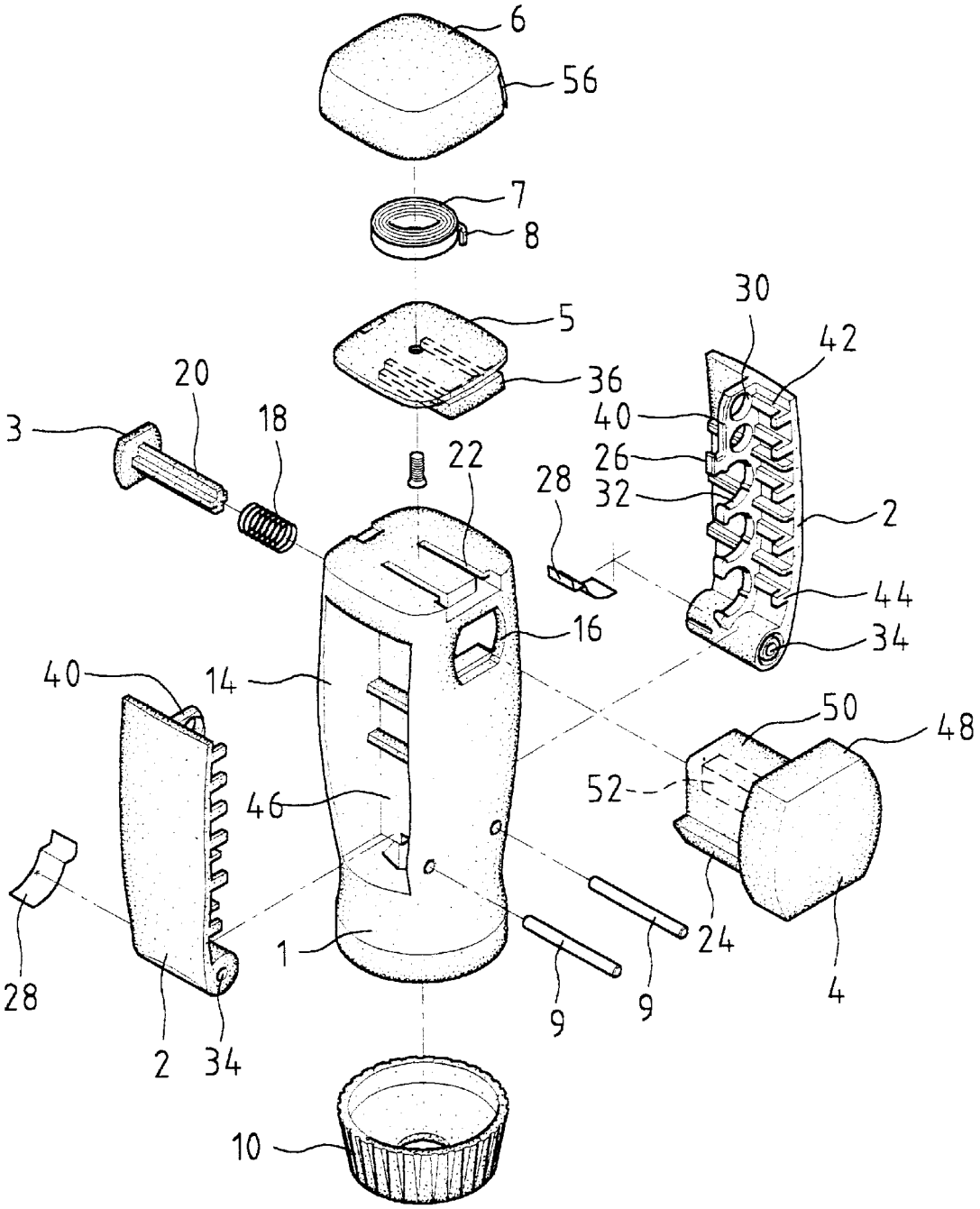
FIG. 1 is an exploded perspective view of a screwdriver handle in accordance with the present invention.
Figure 2:
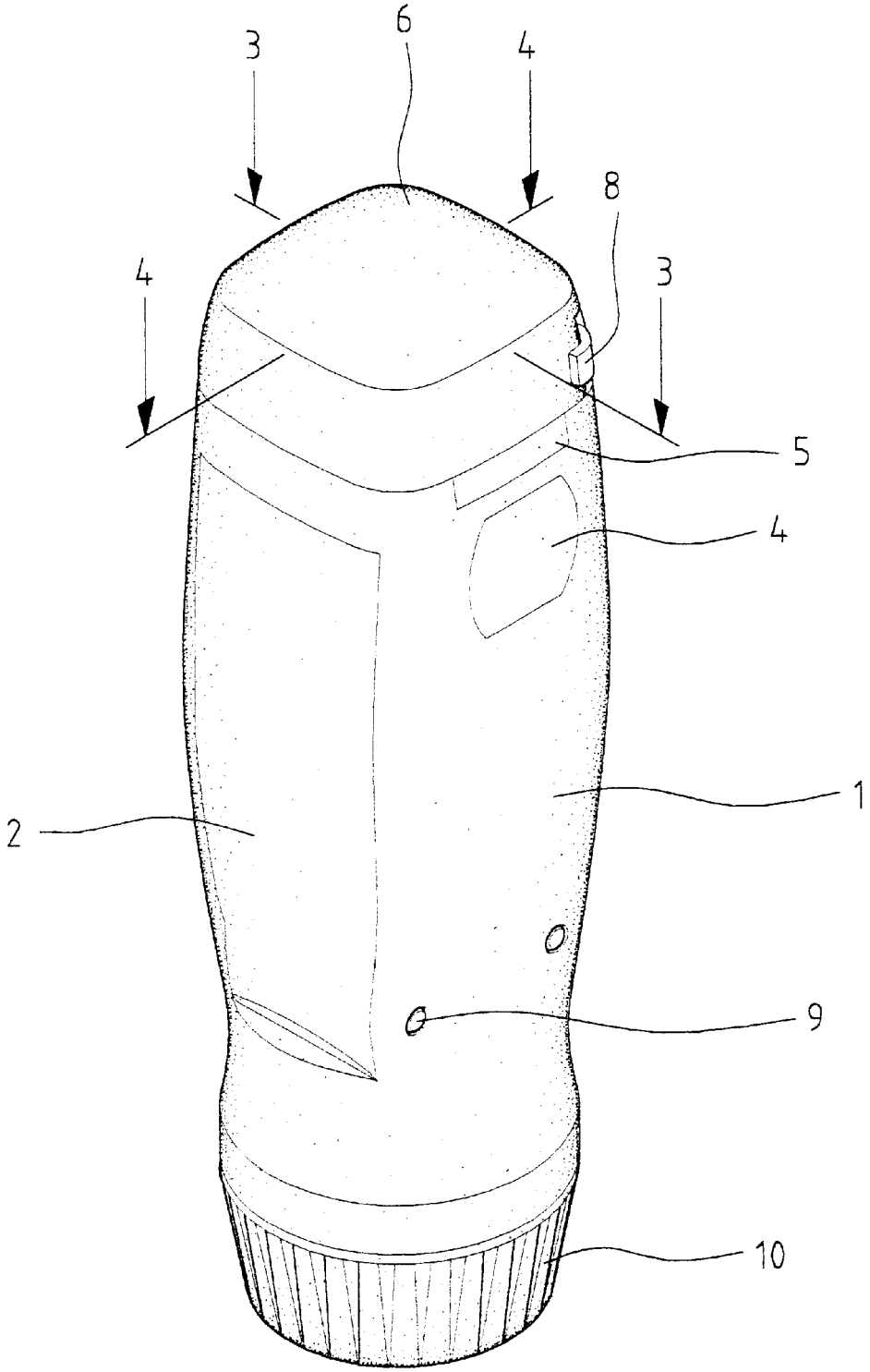
FIG. 2 is a perspective view of the screwdriver handle.
Figure 4:
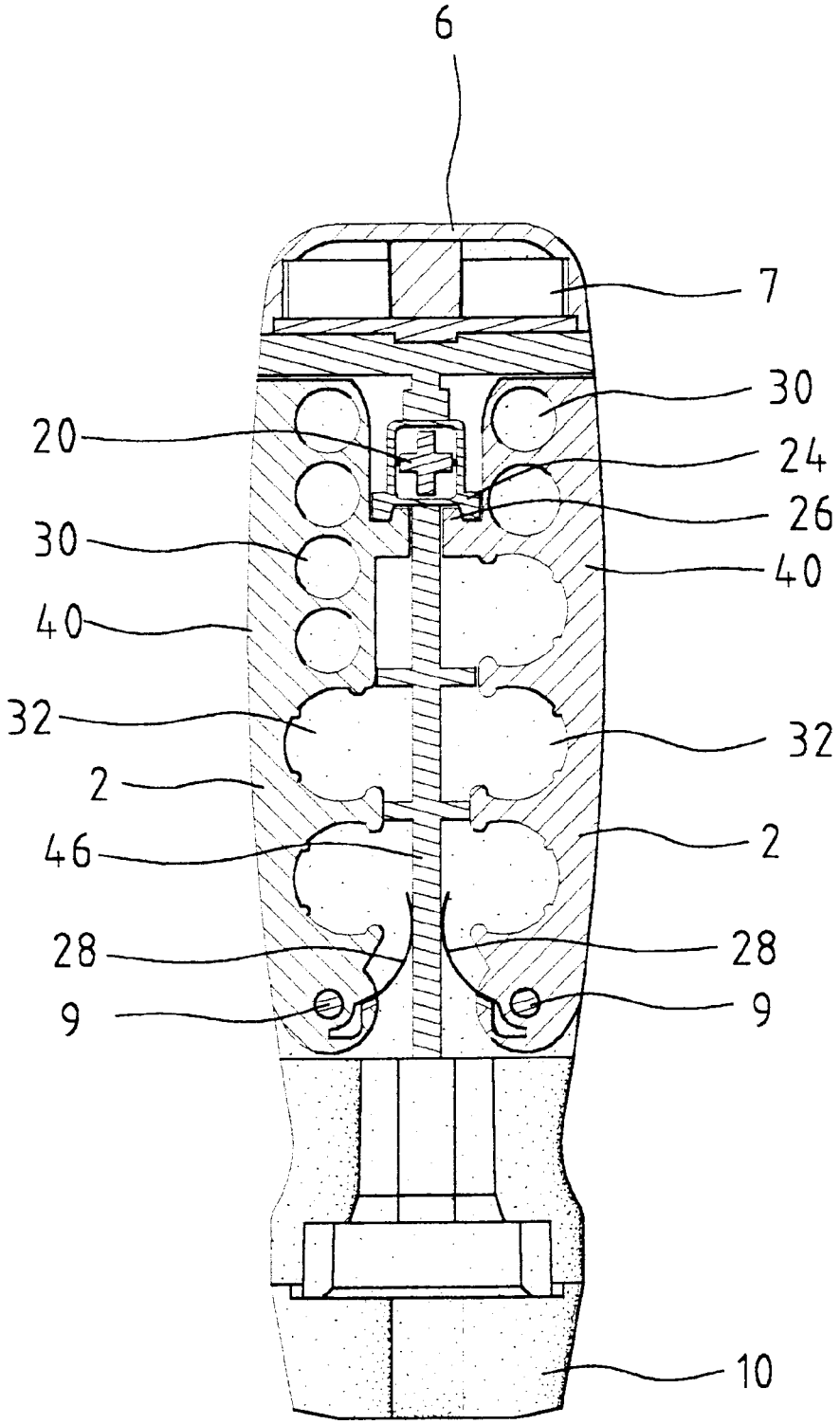
FIG. 4 is a sectional view taken along line 4—4 in FIG. 2.

Referring to the drawings and initially to FIGS. 1 and 2, a screwdriver handle in accordance with the present invention generally includes a main body 1 having two compartments 14 defined in two lateral sides thereof, respectively. Two pivotal covers 2 are pivotally connected to the main body 1 to cover the compartments 14, respectively, in which a pin 9 is extended through a pin hole 34 defined in an end of each pivotal cover 2. An inner side of each pivotal cover 2 includes a holder plate 40 formed thereon, the holder plate 40 including a number of holes 30 each for holding a screwdriver tip (not shown) and a number of semi-circle recesses 32 each for holding a socket (not shown). The holder plate 40 further includes a hook 26 formed thereon, which will be described later. Ribs 42 and 44 may be formed on the inner side of the pivotal cover 2 to assist in the retaining effect of the screwdriver tips and sockets. Referring to FIG. 4, an elastic member 28 is provided to bias each pivotal cover 2 outwardly. In this embodiment, the main body 1 includes a wall 46 formed on a mediate section of an interior thereof and thus separates the two compartments 14. Each elastic member 28 includes a first end attached to the wall 46 and a second end attached to an associated pivotal cover 2. The elastic members 28 are compressed when the pivotal covers 2 are in a closed status.

Figure 3:
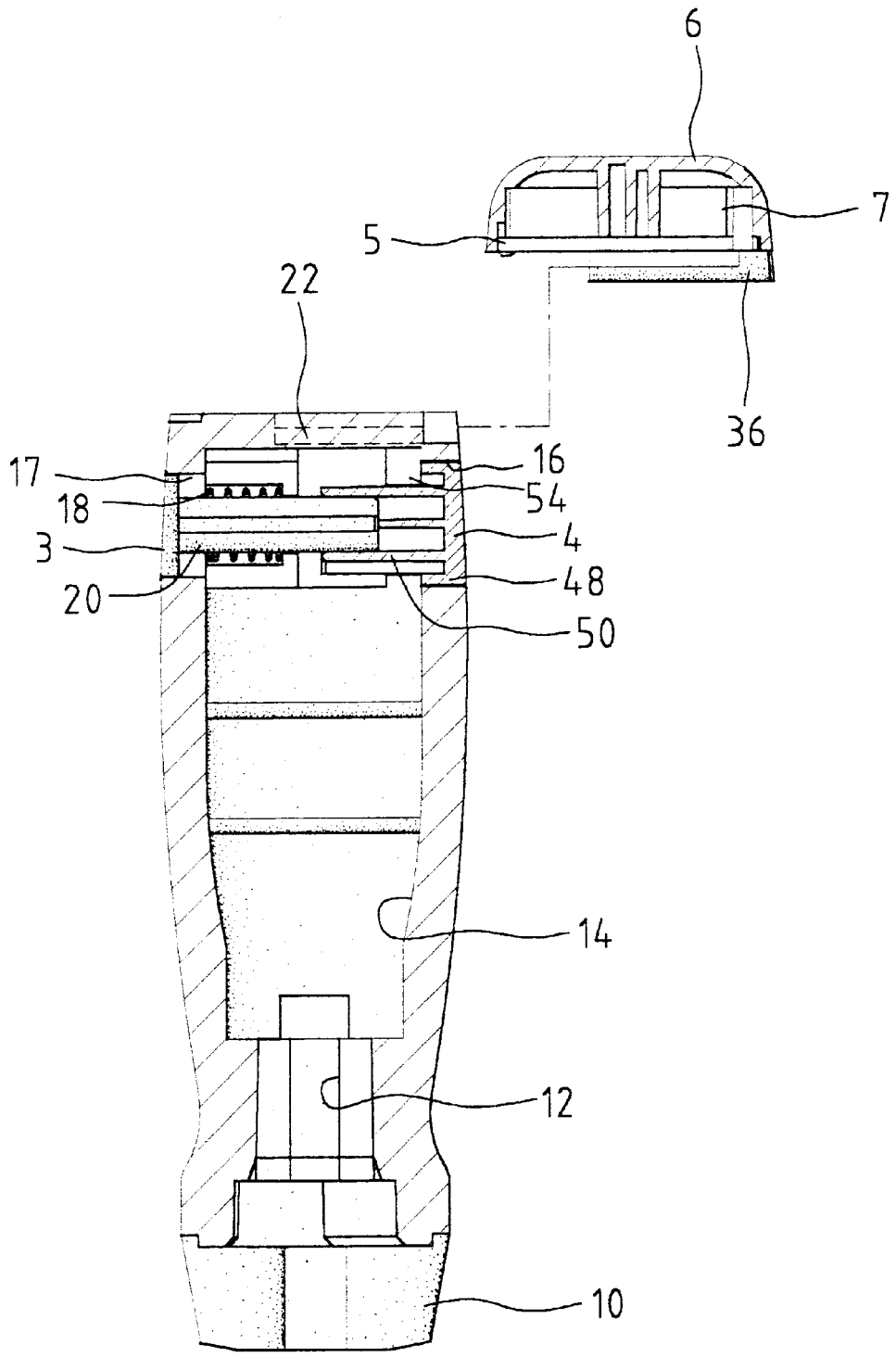
FIG. 3 is a sectional view taken along line 3—3 in FIG. 2.

Referring to FIGS. 1 and 3, the main body 1 further includes a first transverse receptacle 16 and a second transverse receptacle 17 defined in the other two opposite sides thereof, the two receptacles 16 and 17 being communicated with each other. An engaging member 4 includes an enlarged head 48 slidably received in the first transverse receptacle 16 and a stem 50 that extends into the interior of the main body 1. The stem 50 includes a latch 24 formed on each of two lateral sides thereof A push pin 3 is slidably received in the second transverse receptacle 17 and includes a cruciform key 20 that extends into the interior of the main body 1 and engages with a cruciform groove 52 (FIG. 1) defined in the stem 50 of the engaging member 4 to move therewith. A periphery that defines the first transverse receptacle 16 may include a flange 54 formed thereon to prevent from excessive insertion of the enlarged head 48 of the engaging member 4. A spring 18 is mounted around the key 20 of the push pin 3 for returning the push pin 3 and the engaging member 4.

A track 22 is defined in the first end of the main body 2 for sliding engaging with a sliding member 36 of a base plate 5. A housing 6 is securely engaged with the base plate 5 and thus defines a space for a coil ruler 7. Alternatively, the housing 6 may be integral with the base plate 5. The housing 6 includes a notch 56 through which the coil ruler 7 may be extended when in use or returned to its coiled status after use. The coil ruler 7 includes a stop 8 formed on an outer end thereof and having a size greater than that of the notch 56 to prevent from excessive winding of the coil ruler 7 and to allow grasp by fingers when in use. The base plate 5 together with the housing 6 may be detached from the main body 1 when not desired.

Still referring to FIGS. 1 and 3, a chamber 12 is defined in a second end of the main body 1 for retaining an end of a screwdriver tip (not shown), and a rotational cap 10 is in threading connection with the second end of the main body 1 to releasably secure the screwdriver tip in position by means of rotation of the cap 10, which is conventional and therefore not further described.

Figure 5:
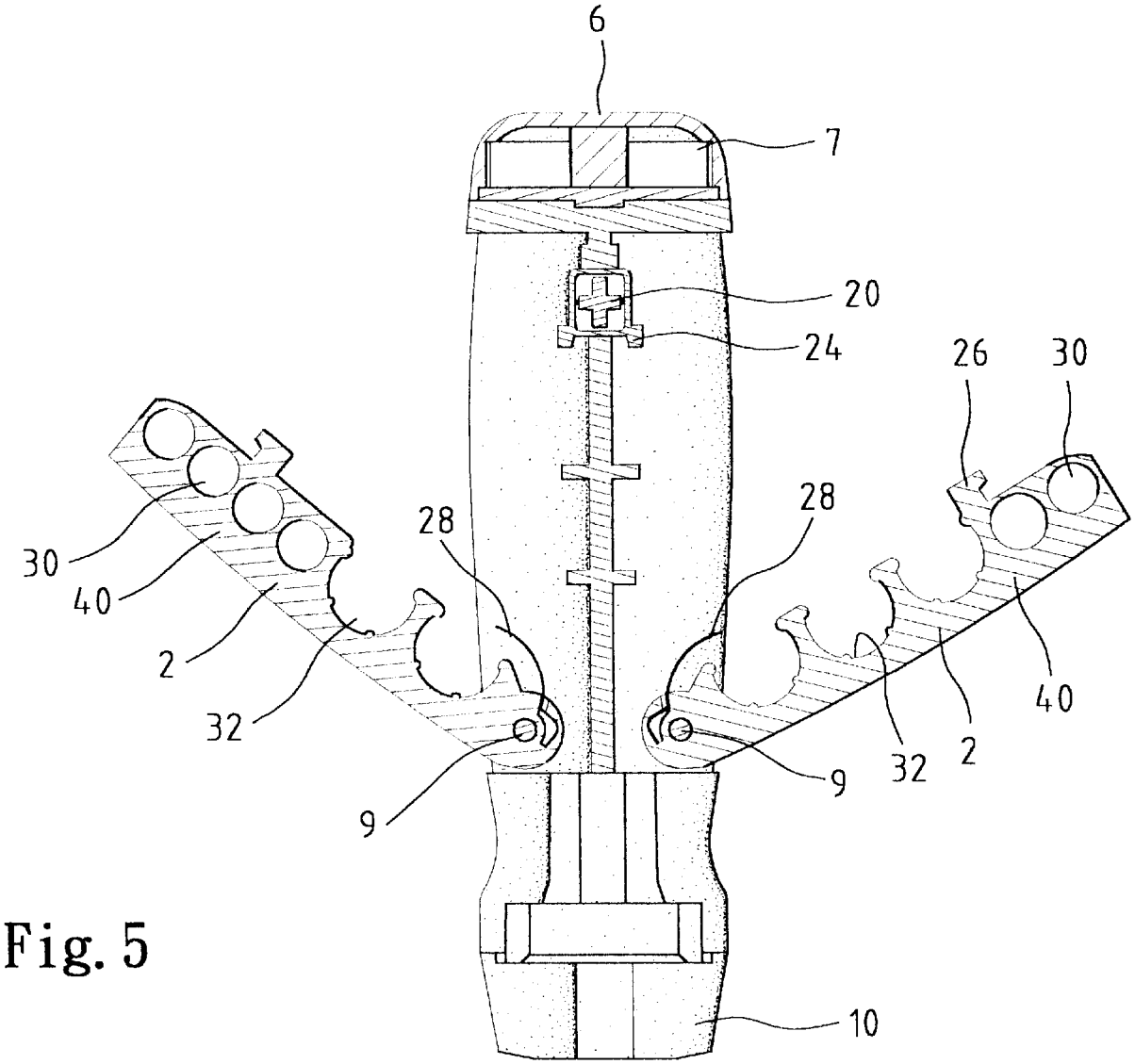
FIG. 5 is a sectional view similar to FIG. 4, illustrating opening of the screwdriver handle.
Figure 6:
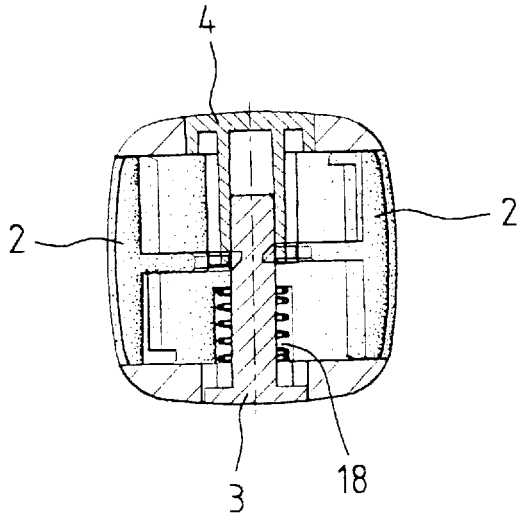
FIGS. 6 to 8 are sectional views illustrating opening operation of the screwdriver handle.
Figure 7:
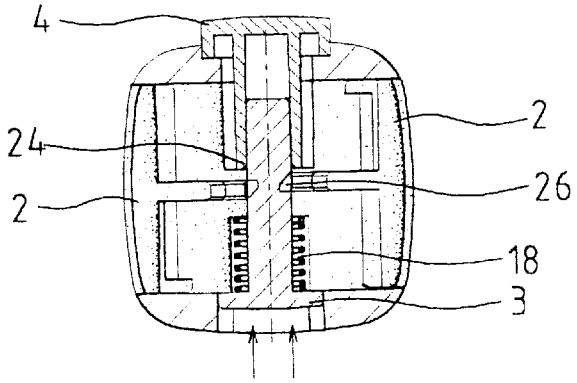
Figure 8:
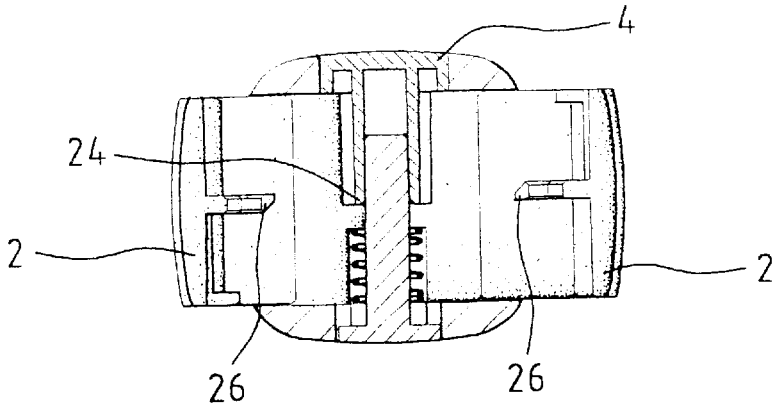

In use, the user may push the push pin 3 to move the push pin 3 from a status shown in FIG. 6 to a status shown in FIG. 7 such that the latches 24 of the engaging member 4 are moved and thus no longer engaged with the hooks 26 of the pivotal covers 2. The pivotal covers 2 pivot outwardly about the pins 9 under the actions of the elastic members 28, as shown in FIGS. 5 and 8. As a result, the screwdriver tips and sockets retained in the pivotal covers 2 are accessible to the user. After use, the pivotal covers 2 are pushed toward the main body 1 such that the hooks 26 reengage with the latches 24, respectively. Of course, the push pin 3 may be pushed to allow re-engagement between the hooks 26 and the latches 4.

According to the above description, it is appreciated that the screwdriver handle of the present invention may receive screwdriver tips and sockets to solve the carriage and storage problem.

Although the invention has been explained in relation to its preferred embodiment, it is to be understood that many other possible modifications and variations can be made without departing from the spirit and scope of the invention as hereinafter claimed.

What claimed is:

1. A screwdriver handle comprising a main body having a first end and a second end adapted to be releasably engaged with an end of a screwdriver tip, main body including a first pair of opposite lateral sides and a second pair of opposite lateral sides, each of the first pair of opposite lateral walls including a compartment defined therein, the main body including a wall defined in an interior thereof and separating the compartments, two pivotal covers each having an end pivotally connected to the main body to cover an associated said compartment, each said pivotal cover including a holder plate formed on an inner side thereof and having a number of holes each of which is adapted to hold a screwdriver tip and a number of semi-circle recesses each of which is adapted to hold a socket, each said holder plate including a hook formed thereon, two elastic members each having a first end attached to the wall of the main body and a second end attached to an associated said pivotal cover, the elastic members being compressed when the pivotal covers are in a closed status, a first transverse receptacle and a second transverse receptacle defined in the second pair of opposite lateral sides, respectively, the first transverse receptacle includes an engaging member slidably received therein, the engaging member including a latch provided on each of two lateral sides thereof for releasably engaged with the hook of an associated said pivotal cover, the second transverse receptacle including a push pin slidably received therein, the push pin being securely connected to the engaging member to move therewith, and a spring being provided for returning the push pin and the engaging member, whereby when the push pin is pushed, the latches of the engaging member are moved to a position not engaged with the hooks of the pivotal covers such that the pivotal covers pivot outwardly under the action of the elastic members.

2. The screwdriver handle according to claim 1, wherein the first end of the main body includes a track defined therein, and further comprises:

a housing having a base plate with a sliding member slidably received in the track, the housing including a notch defined in a periphery thereof, and a coil ruler received in the housing and includes a stop formed on an outer end thereof, the stop having a size greater than that of the notch of the housing.

* * * * *